US011261883B2

(12) United States Patent
Schaupp et al.

(10) Patent No.: US 11,261,883 B2
(45) Date of Patent: Mar. 1, 2022

(54) SELF-CLEANING PNEUMATIC FLUID PUMP HAVING POPPET VALVE WITH PROPELLER-LIKE CLEANING STRUCTURE

(71) Applicant: Q.E.D. Environmental Systems, Inc., Dexter, MI (US)

(72) Inventors: John F. Schaupp, Sylvania, OH (US); Donald Lee Schultz, Jackson, MI (US); Bradley Peake, Tecumseh, MI (US)

(73) Assignee: Q.E.D. Environmental Systems, Inc., Dexter, MI (US)

( * ) Notice: Subject to any disclaimer, the term of this patent is extended or adjusted under 35 U.S.C. 154(b) by 0 days.

(21) Appl. No.: 16/751,488

(22) Filed: Jan. 24, 2020

(65) Prior Publication Data

US 2020/0263705 A1 Aug. 20, 2020

Related U.S. Application Data

(60) Provisional application No. 62/806,329, filed on Feb. 15, 2019.

(51) Int. Cl.

| | |
|---|---|
| ***F01D 1/00*** | (2006.01) |
| ***F04D 29/70*** | (2006.01) |
| ***F15D 1/00*** | (2006.01) |

(52) U.S. Cl.

CPC ..... *F04D 29/708* (2013.01); *F15D 1/0015* (2013.01)

(58) Field of Classification Search

CPC ..... F04D 29/708; F15D 1/0015
USPC ..... 415/182.1
See application file for complete search history.

(56) References Cited

U.S. PATENT DOCUMENTS

| | | | | |
|---|---|---|---|---|
| 5,314,018 | A * | 5/1994 | Cobb | E21B 43/38 166/105.1 |
| 5,346,016 | A * | 9/1994 | Wilson | E21B 17/1014 166/380 |
| 5,593,292 | A * | 1/1997 | Ivey | F04B 53/1007 137/533.15 |
| 5,810,081 | A * | 9/1998 | Cobb | E21B 17/00 166/105.3 |
| 6,138,757 | A * | 10/2000 | Latos | E21B 21/14 166/265 |
| 7,635,430 | B2 * | 12/2009 | Mildren | B04C 5/08 166/75.11 |
| 8,333,239 | B2 * | 12/2012 | Schneider | E21B 43/20 166/261 |
| 8,939,217 | B2 * | 1/2015 | Kolle | E21B 28/00 166/373 |
| 9,045,979 | B2 * | 6/2015 | Cobb | E21B 43/38 |
| 9,982,693 | B2 * | 5/2018 | Nord | F15D 1/025 |
| 2007/0017674 | A1 | 1/2007 | Blaisdell | |

(Continued)

*Primary Examiner* — Hung Q Nguyen
*Assistant Examiner* — Anthony Donald Taylor, Jr.
(74) *Attorney, Agent, or Firm* — Kinney & Lange, P. A.

(57) ABSTRACT

The present disclosure relates to a flow turning system for imparting a rotational, swirling motion to a fluid flowing through the flow turning system. The system may comprise a housing and a flow turning element supported within the housing. The flow turning element may have a plurality of circumferentially spaced vanes projecting into a flow path of the fluid as the fluid flows through the flow turning system. The vanes impart a swirling, circumferential flow to the fluid to help prevent contaminants in the fluid from adhering to downstream components in communication with the flow turning system.

19 Claims, 11 Drawing Sheets

(56) References Cited

U.S. PATENT DOCUMENTS

| | | | | |
|---|---|---|---|---|
| 2008/0060712 | A1* | 3/2008 | Gluzman | F15D 1/0005 138/39 |
| 2009/0065431 | A1* | 3/2009 | Bakke | B01D 17/0217 210/512.1 |
| 2009/0301710 | A1* | 12/2009 | Clem | E21B 17/22 166/242.1 |
| 2009/0308472 | A1* | 12/2009 | Harman | B01F 5/0615 137/808 |
| 2011/0267922 | A1* | 11/2011 | Shampine | E21B 47/005 367/25 |
| 2014/0127065 | A1 | 5/2014 | Hansen | |
| 2014/0151068 | A1* | 6/2014 | Gilleylen | E21B 28/00 166/381 |
| 2014/0202702 | A1* | 7/2014 | Cobb | E21B 21/062 166/307 |
| 2016/0356134 | A1* | 12/2016 | Ramirez | F04F 1/06 |
| 2018/0149177 | A1* | 5/2018 | Moger, IV | F15D 1/02 |

* cited by examiner

SELF-CLEANING PNEUMATIC FLUID PUMP HAVING POPPET VALVE WITH PROPELLER-LIKE CLEANING STRUCTURE

CROSS-REFERENCE TO RELATED APPLICATIONS

This application claims the benefit of U.S. Provisional Application No. 62/806,329, filed on Feb. 15, 2019. The entire disclosure of the above application is incorporated herein by reference.

FIELD

The present disclosure relates to fluid pumps, and more particularly to a fluid pump system which incorporates a fluid flow turning subsystem which enables fluid being discharged from the pump into the pump's discharge line to be turned into a swirling flow which helps significantly in maintaining the discharge line clean and free of contaminants.

BACKGROUND

This section provides background information related to the present disclosure which is not necessarily prior art.

In a pneumatic piston-less liquid pump, air pressure is used to displace the liquid inside the pump casing. It is common for the air inlet port to be centrally located in the casing. This location provides a compressed air source which is moving in the middle of the pump casing and the outlet pipes leaving the pump casing. The inside of the pump casing is filled with water which is admitted into the pump casing from the lower end of the pump. At the lower end of the pump there is an inlet port. This inlet port has a sealing surface which can be sealed by an inlet poppet valve. The inlet poppet valve is allowed to rise off of the sealing surface, which allows water to enter the pump casing. The poppet valve is returned to its valve seat (i.e., the sealing surface) as soon as the pneumatic signal being supplied to the pump energizes the pump casing. This seating on this valve seat blocks the flow of water back to the well, as water within the pump casing is forced upwardly by the pneumatic pressure through the outlet pipe attached to an upper end of the pump casing. This sequence happens every time a pumping cycle is triggered.

The liquid being pumped from the wellbore will typically have particles which will deposit on the inside pump casing walls, in the discharge piping, the inlet casting and over an inlet screen that covers the valve seat at the lowermost end of the pump. These components need to be kept clean to allow for long durations between maintenance cycles. When maintenance on a pump needs to be performed the pump, the pump is removed from the well and typically disconnected from its air supply tubing and its fluid outlet (i.e., discharge) tubing. Typically the pump is taken back to a maintenance area and then disassembled, its interior parts cleaned and scrubbed clean, and then reassembled. If the discharge tubing has accumulated a significant degree of contaminants on its inside surface, then cleaning of the discharge tube becomes necessary as well. If the contaminant buildup within the discharge tubing is extensive, then replacement of the discharge tubing may become necessary.

Maintaining the discharge tubing clean is therefore especially important as contaminants adhering to its interior surface may break free and interfere with operation of other downstream components which are in contact with the fluid being pumped by the pump system. Until the present time, however, there has been no inexpensive, easy to implement subsystem for helping to maintain the discharge tubing of a fluid pump system clean.

SUMMARY

In one aspect the present disclosure relates to a fluid turning system for communication with a pump. The system may comprise a housing for receiving a fluid flow. A flow turning element may be included in the housing and have a plurality of circumferentially spaced vanes projecting into a flow path of the fluid as the fluid flows through the flow turning subsystem. The vanes may impart a swirling, circumferential flow to the fluid to help prevent contaminants in the fluid from adhering to downstream components.

In another aspect the present disclosure relates to a system for imparting a swirling motion to a flowing fluid. The system may comprise an upper outer housing component. A lower outer housing component may be securable to the upper outer housing component. A ring-like flow turning element may be included and captured between the upper and lower outer housing components. The ring-like flow turning element may include a plurality of circumferentially spaced vanes projecting into a flow path of the fluid as the fluid flows through the system. The vanes may impart a swirling, circumferential flow to the fluid to help prevent contaminants in the fluid from adhering to downstream components in communication with the system.

In still another aspect the present disclosure relates to a flow turning system for use with a discharge conduit operably associated with a discharge port of a fluid pump. The flow turning system may comprise an upper outer housing component and a lower outer housing component securable to the upper outer housing component, and a ring-like flow turning element captured between the upper and lower outer housing component, and housed within at least one of the upper and lower outer housing components. The ring-like turning element may include a plurality of circumferentially spaced vanes projecting into a flow path of the fluid as the fluid flows through the flow turning system. The vanes may impart a swirling, circumferential flow to the fluid to help prevent contaminants in the fluid from adhering to downstream components in communication with the flow turning system.

Further areas of applicability will become apparent from the description provided herein. It should be understood that the description and specific examples are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings, in which:

FIG. 1 is a high level illustration of a pneumatic fluid pump in accordance with one embodiment of the present disclosure, positioned in a wellbore, and with various other components show which are typically used in connection with the fluid pump;

FIG. 2 is a cross-sectional view of a portion of the pneumatic fluid pump of FIG. 1 showing only a lower area of the pump and a portion of the discharge tube assembly, with a discharge poppet of the discharge tube assembly shown in a seated position within the discharge housing, which is the position the discharge poppet assumes when the pump housing is filling with fluid during a "fill" cycle of operation;

Figure 10:
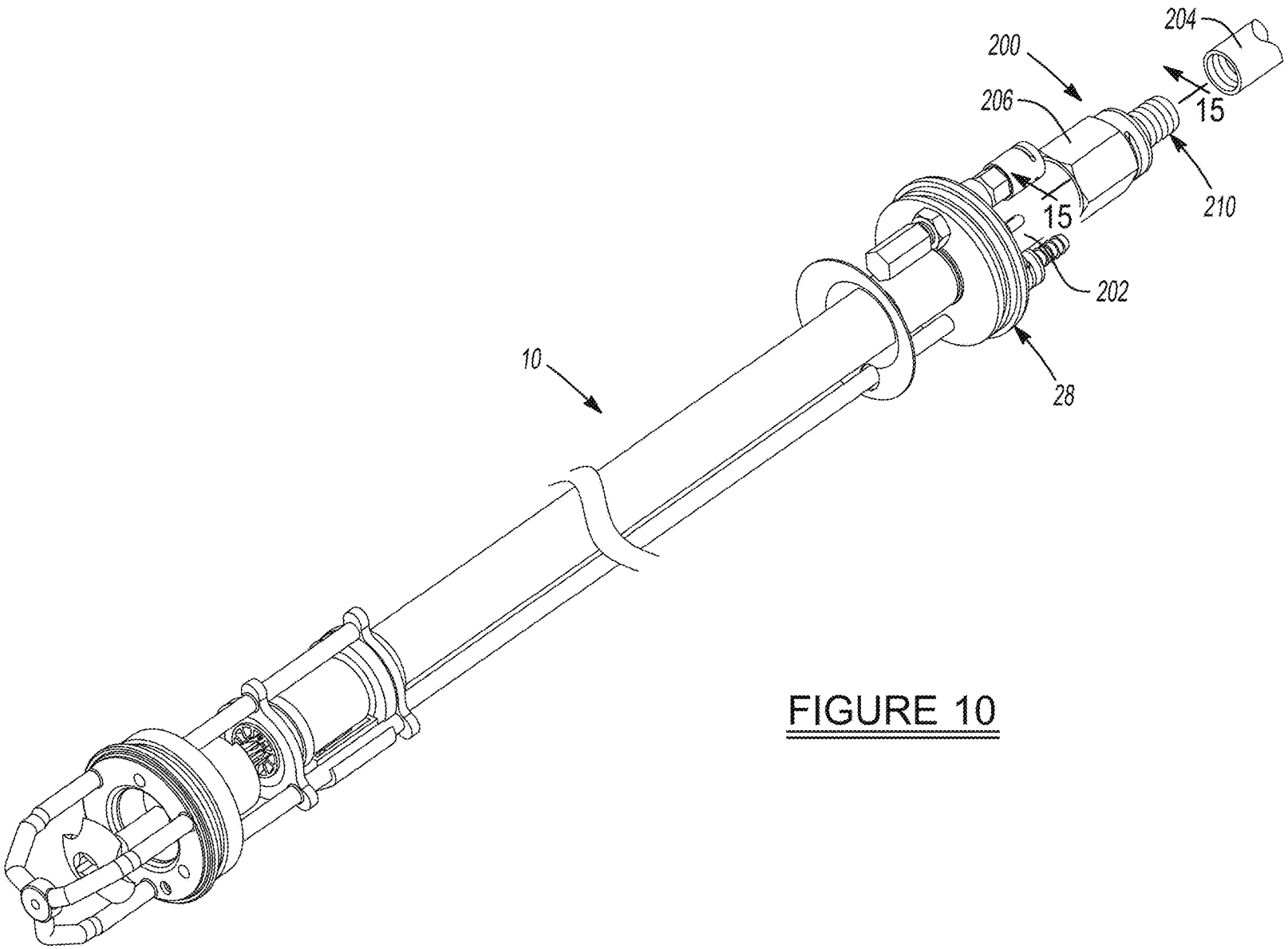
FIG. 10 shows a perspective view of a portion of the pump (excluding the pump housing) of FIG. 1, where the head assembly of the pump is coupled to a fluid turning system of the present disclosure, which imparts a strong swirling rotation to the fluid being discharged from the pump, which helps significantly to maintain the discharge tubing clean and substantially free of debris.
Figure 12:
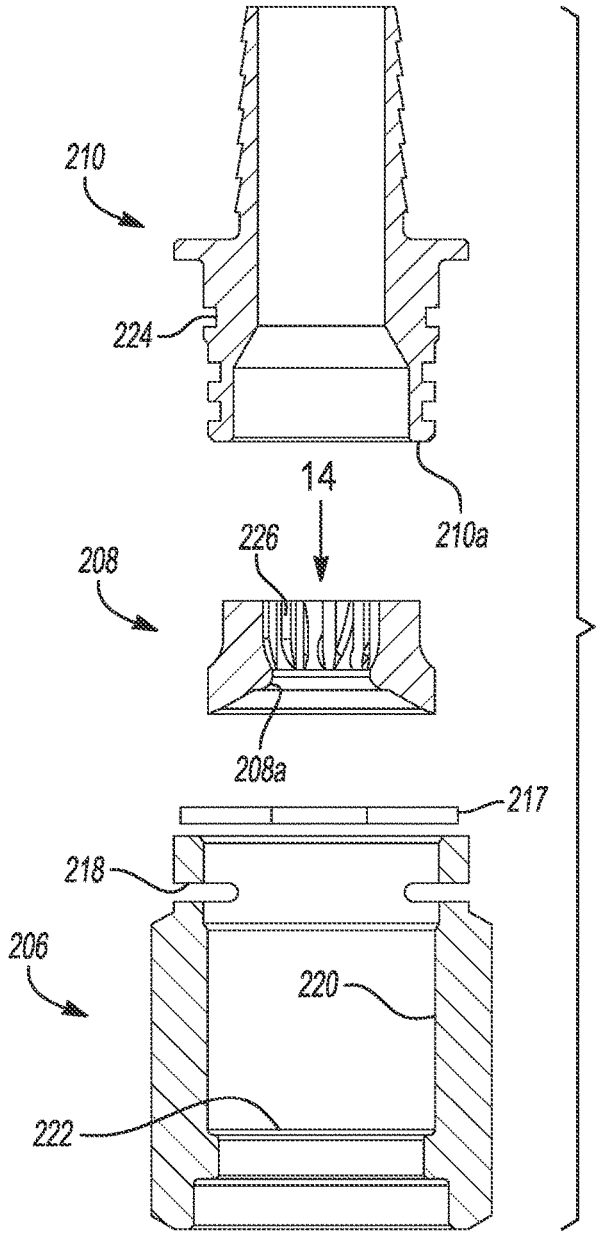
FIG. 12 is an enlarged, exploded cross sectional side view of the components of the fluid turning system in accordance with section line 12-12 in FIG. 11.
Figure 14:
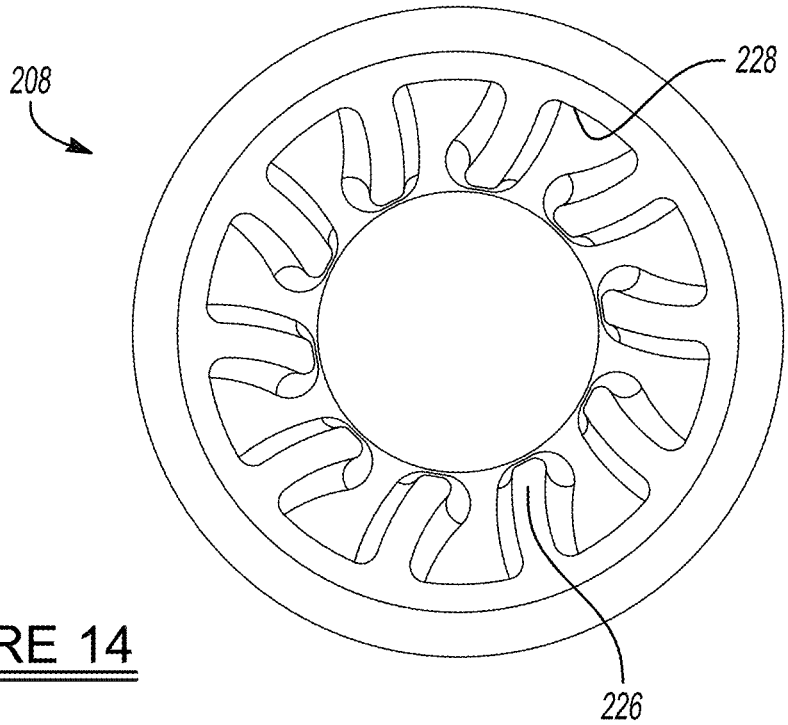
Figure 15:
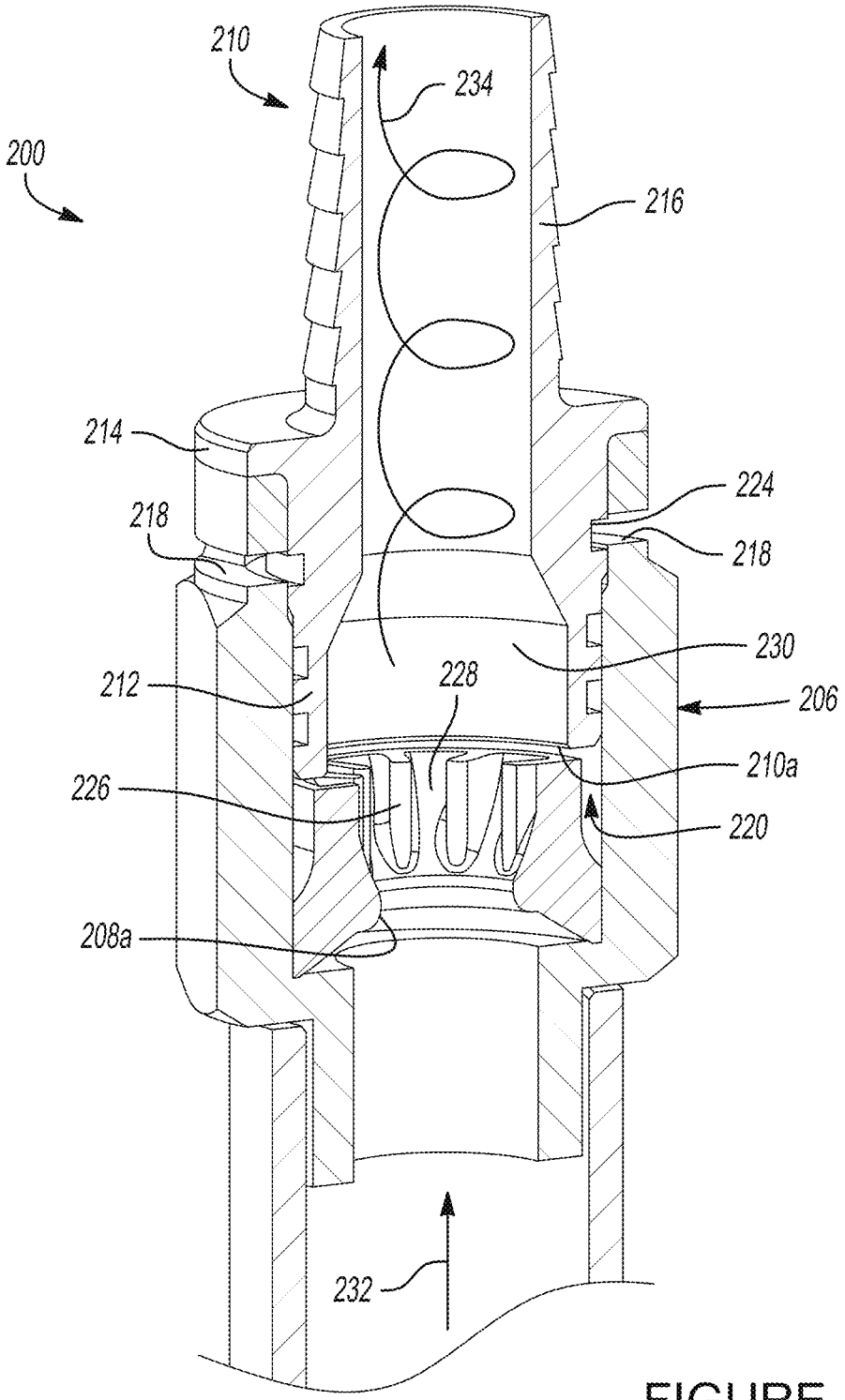

FIG. 14 is an enlarged plan view of just the flow turning element in accordance with directional arrow 14 in FIG. 12; and FIG. 15 is an enlarged cross sectional perspective view taken in accordance with section line 15-15 in FIG. 10 showing the internal construction of the components of the fluid turning system, along with arrows indicating how the generally linear flow entering the flow turning system is transformed into a swirling flow as it leaves the flow turning system.

DETAILED DESCRIPTION

Example embodiments will now be described more fully with reference to the accompanying drawings.

Figure 1:
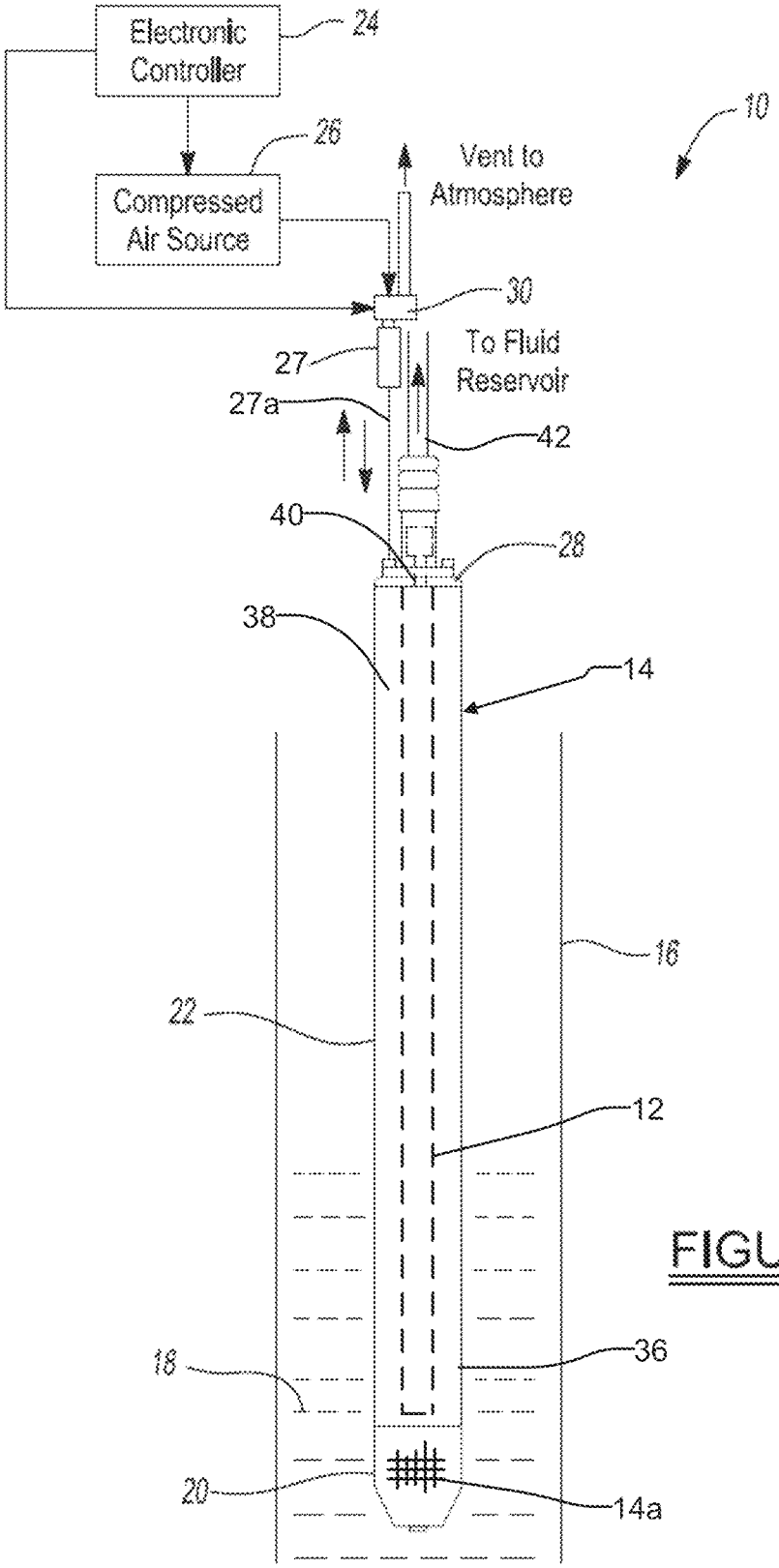

Referring to FIG. 1, a system 10 is shown incorporating one embodiment of a discharge tube assembly 12 in accordance with the present disclosure. The system 10 includes a pneumatically driven pump 14 which is positioned in a wellbore 16 filled with a fluid 18. A lower end 20 of the pump 14 includes a screened inlet 14*a* through which the fluid 18 may flow and enter and collect within an interior area of a tubular pump housing 22 of the pump.

An electronic controller 24 may be used to control the application of compressed air from a compressed air source 26 to the pump 14. The compressed air may be applied to a flow nozzle 27 and directed through a section of suitable tubing (e.g., plastic or rubber) 27*a* to a head assembly 28, and then into the interior area of the pump housing 22. Alternatively, it is possible that the flow nozzle 27 may be coupled directly to the head assembly 28 of the pump 14 so that no intermediate length of tubing is needed. In either event, the electronic controller 24 may control a valve 30 (e.g., a solenoid valve) so that the valve is closed while the compressed air source 26 is applying compressed air to the pump 14, and may open the valve to vent the interior of the pump housing 22 to atmosphere after a fluid ejection cycle is complete. In one example the valve 30 may be a Humphrey 250A solenoid valve available from the Humphrey Products Company of Kalamazoo, Mich. Optionally, a "quick exhaust" valve (not shown) may be incorporated between the flow nozzle 27 and the exhaust valve 30. The quick exhaust valve allows pressurized air to be directed into the pump 14 while allowing exhaust air to be expelled out to the ambient environment, which can potentially help reduce any possible contaminant build up in the valve 30 or and/or its vent port that vents to the atmosphere.

It will also be appreciated that the discharge tube assembly 12 described herein may be employed in a fluid pump which has no electronic controller, but rather simply is turned on and off through actuation of a float mechanism which rises and falls in accordance with the changing fluid level in the wellbore 16. For the purpose of the following discussion, it will be assumed that the pump 14 is being used with the electronic controller 24.

The pump 14 may include an inlet screen 14*a* at an extreme lower end 36 of the pump housing 22. The inlet screen 14*a* allows the fluid 18 collecting within the wellbore 16 to collect inside the housing 22 in the vicinity of the lower end 36. When compressed fluid (e.g., air) is applied while the valve 30 is closed, the fluid within the housing 22 will be forced into and upwardly through the discharge tube assembly 12 toward an upper end 38 of the pump housing 22, and then out through a discharge port 40 in the head assembly 28. As will be described further in the following paragraphs, the discharge tube assembly 12 operates to impart a strong, swirling motion to the fluid 18 while the fluid is entering and passing through the discharge tube assembly 12, which helps significantly to help keep interior components and interior portions of the discharge tube assembly 12. This is especially important considering that the fluid 18 within the wellbore 16 is often heavily laden with particle contaminants that can quickly and easily cause a buildup of contaminants, similar to a sludge-like formation, on the interior portions of a conventional discharge tube/assembly. With conventional pneumatic pumps used in a wellbore, the quick build-up of contaminants often necessitates frequent removal, disassembly, cleaning and reassembly of the pump 14, which is time consuming, labor intensive, and can be somewhat costly when considering the manual labor involved. As will be explained more fully, the construction of the discharge tube assembly 12 significantly reduces the build-up of contaminants inside the discharge tube assembly 12, and thus can significantly increase the time interval between when the pump 14 needs to be removed and disassembled for cleaning.

With further brief reference to FIG. 1, fluid 18 being ejected through the discharge tube assembly 12 is ejected through the discharge port 40. The ejected fluid 18 leaving the discharge port 40 may flow through a suitable tubing or conduit 42 to a suitable fluid reservoir.

Figure 2:
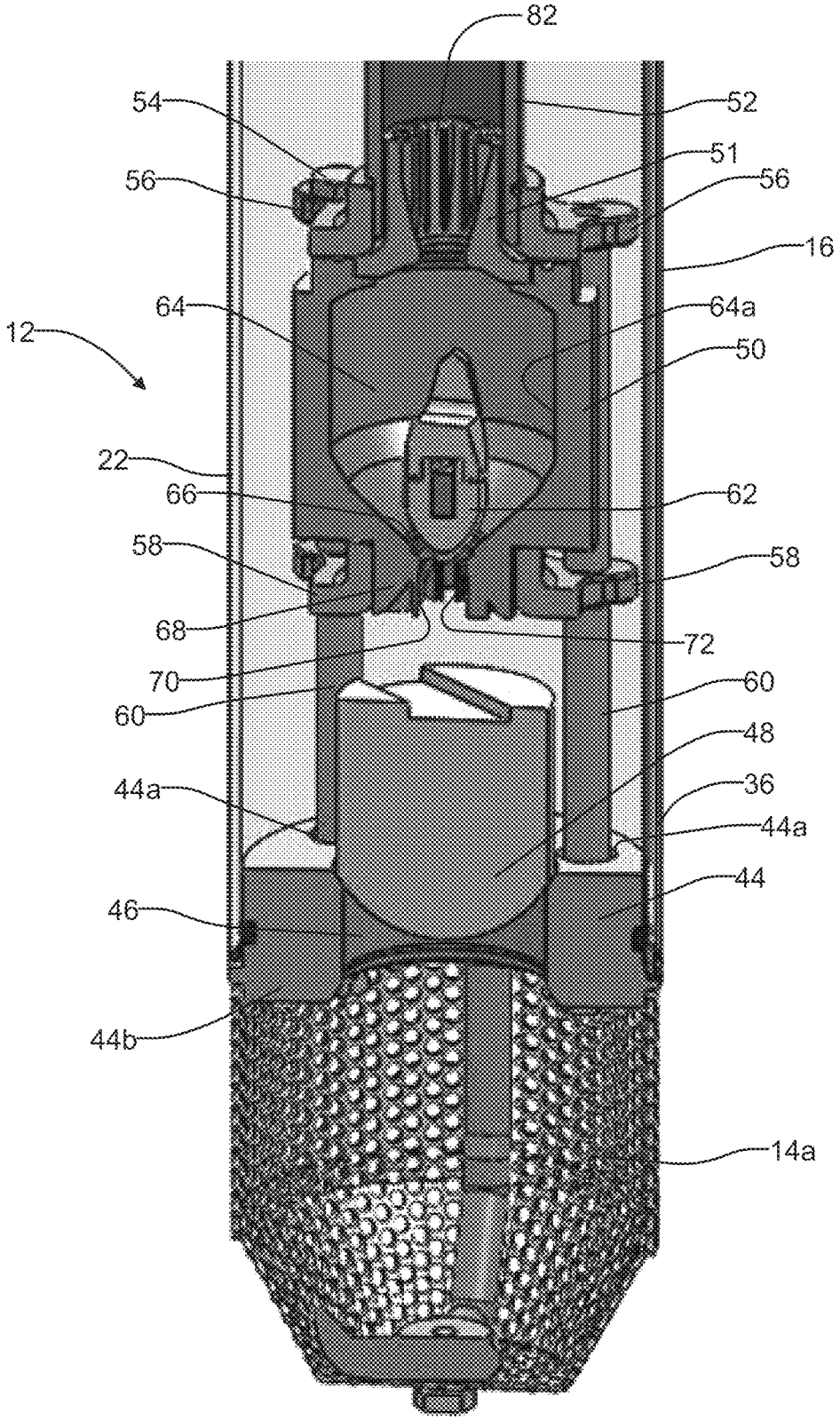

Referring to FIG. 2, a more detailed view of a portion of the discharge tube assembly 12 can be seen along with several other internal components of the pump 14. Initially, the pump 14 may include an inlet casting 44 secured within the lower area of the tubular housing 32 to form a fluid tight seal with the inside surface of the tubular housing 32, and for helping to maintain the discharge tube assembly 12 centered within the tubular housing. The inlet casting 44 includes an opening 46 in which a fluid inlet poppet valve 48 is seated, and which closes off the interior of the tubular pump housing 22 when compressed fluid is directed in the tubular pump housing 22 during a fluid discharge cycle.

Figure 3:
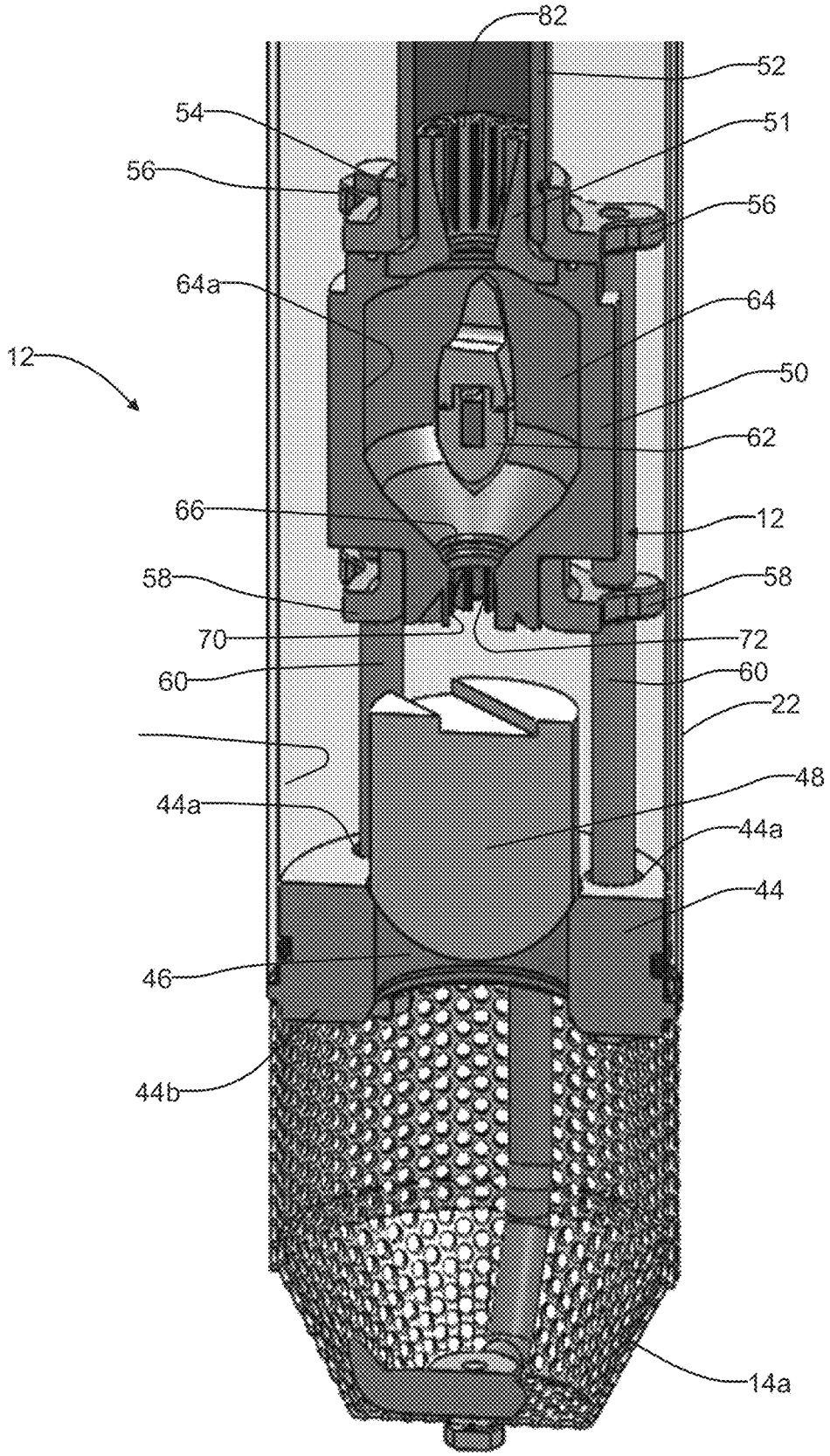
FIG. 3 shows the fluid pump of FIG. 2 but with the discharge poppet in the open position, which is the position the discharge poppet assumes when the fluid pump is in a "discharge" or "ejection" cycle of operation.

With further reference to FIGS. 2 and 3, a discharge housing 50, a discharge swirl inducing fitting 51, and a main tubular section 52 form a portion of the discharge tube assembly 12. The discharge housing 12 is held stationary within the tubular housing 22 by three threaded screws 54 (only one being visible in FIGS. 2 and 3), which are threaded into and extend through flange portions 56 and 58 of the discharge housing 50. Ends of sleeves 60 are threaded into engagement with threaded bores 44*a* in the inlet casting 44. There is a clearance hole (not visible) in the inlet casting 44 44 which allows the bolts 54 through a bottom side 44*b* of the inlet casting 44 so they can be used to secure the discharge tube assembly 12 stationary within the pump housing 22.

With further reference to FIGS. 2 and 3, a discharge poppet 62 is positioned within an interior area 64 of the discharge housing 50 and rests on an inlet face 66 of the discharge housing when the pump 14 is operating in a fill cycle, and no pressurized fluid is being admitted into the interior of the pump housing 22. The inlet face 66 communicates with an inlet structure 68 that includes an inlet port 70, which forms the entry path for fluid entering the discharge housing 50.

Figure 4:
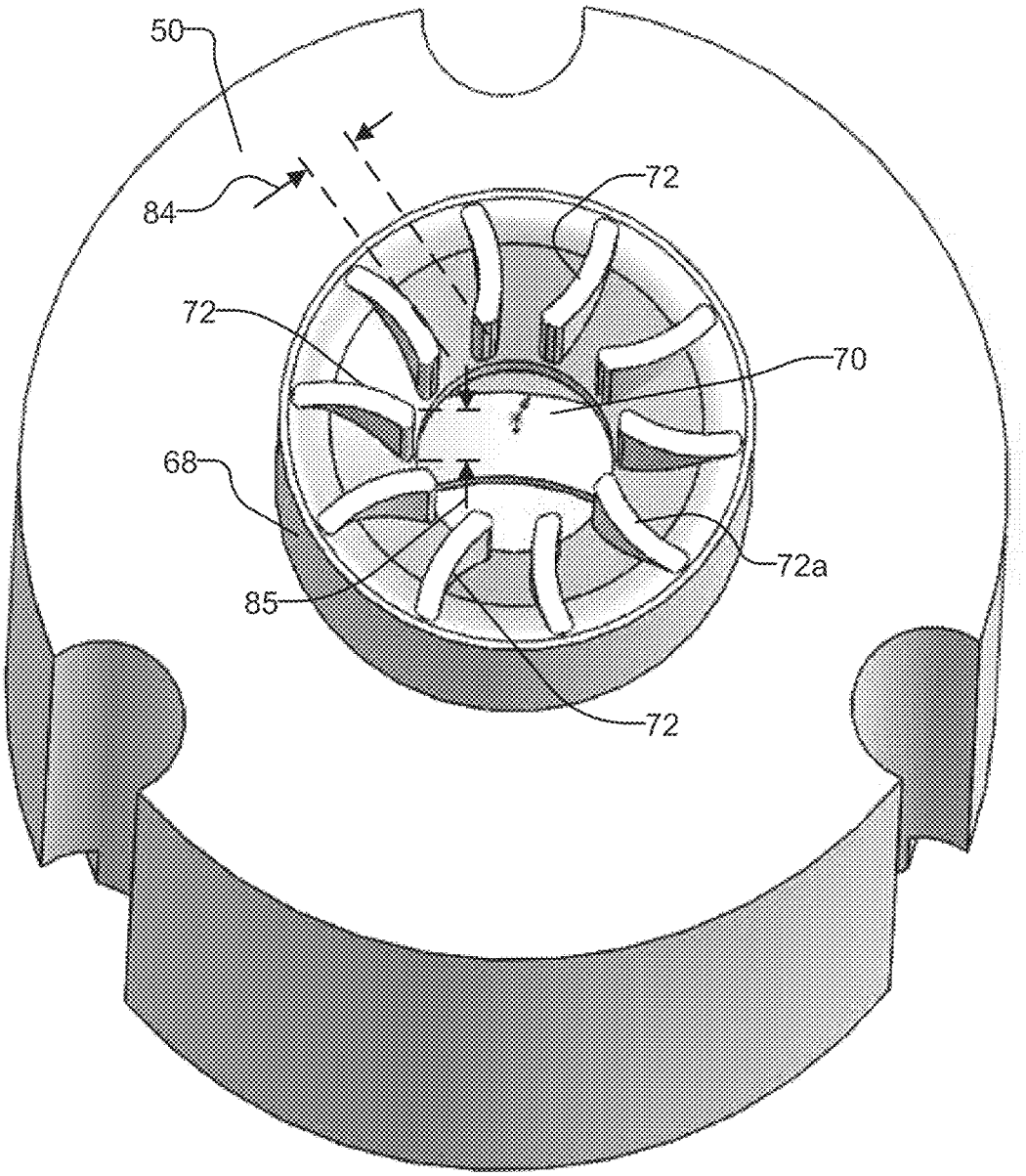
FIG. 4 shows a bottom perspective view of the inlet structure of the discharge housing which even better illustrates the radially extending vanes that are included to impart a strong swirling motion to the fluid entering the discharge housing.

With reference to FIGS. 2 and 4, the inlet structure 68 of the discharge housing 50 includes a plurality of arcuate flow turning vanes 72 which extend radially from the inlet port 70. The arcuate flow turning vanes 72 in this example have a concave, angled surface 72*a*, and operate to impart a strong swirling flow to the fluid 18 as the fluid is forced into through the inlet port 70 into the interior area 64 of the discharge housing 50 by a pressurized fluid (e.g., compressed air) during an ejection cycle. The strong swirling motion of the fluid helps to clean both the surfaces of both the discharge poppet 62, as well as an interior wall 64*a* (shown in FIGS. 2 and 3 only) which defines the interior area 64 of the discharge housing 50, every time the pump 14 goes through an ejection cycle of operation.

Figure 5:
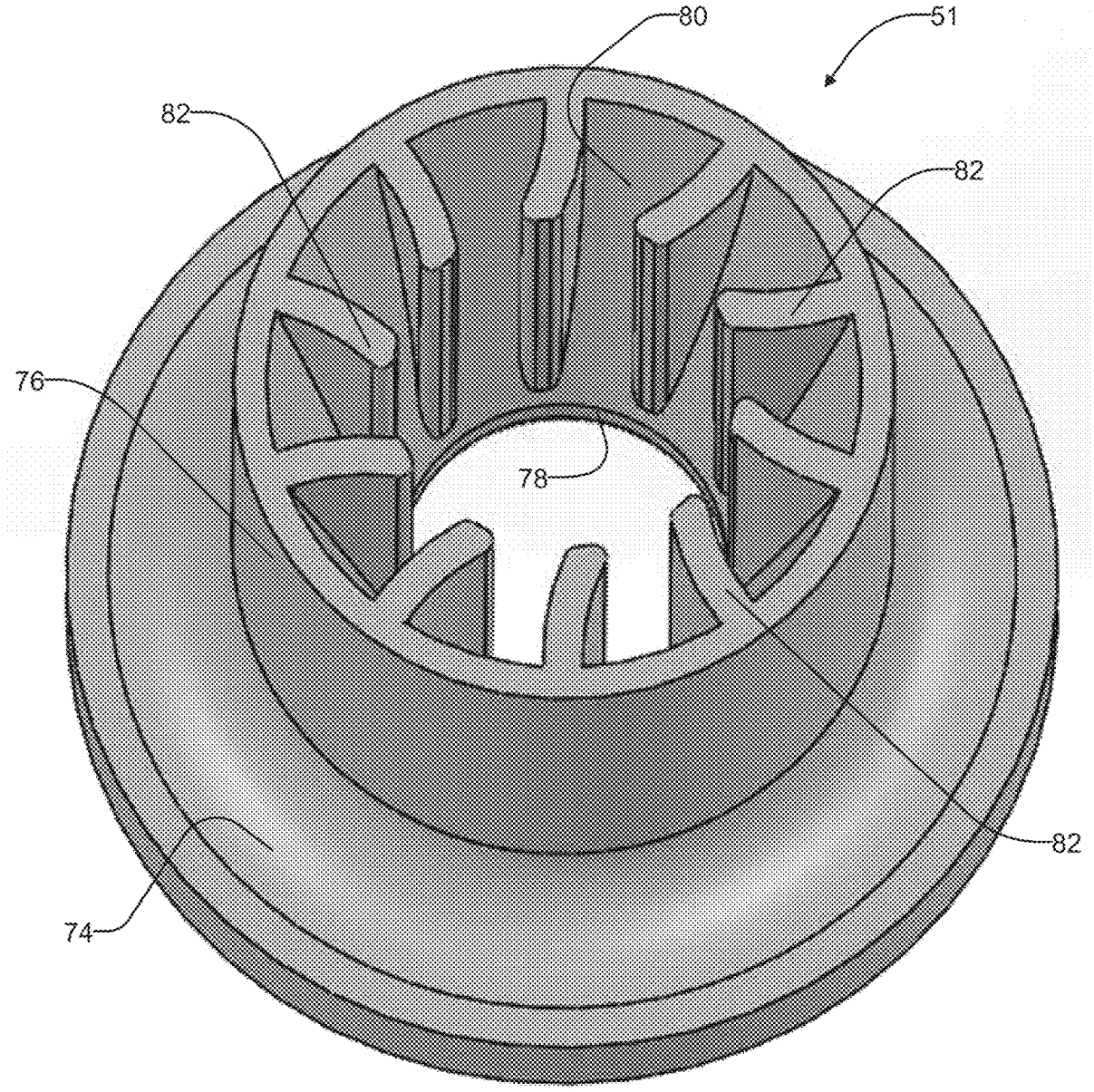
FIG. 5 shows a top perspective view of the discharge swirl inducing fitting that is included in the discharge housing for further enhancing the swirling motion of the fluid being discharged as the fluid flows up the main tubular section of the discharge tube assembly.

With reference to FIG. 5, the discharge swirl inducing ("DSI") fitting 51 can be seen in greater detail. The DSI fitting 51 includes a flange portion 74 from which a neck portion 76 extends. The neck portion 76 includes a bore 78 and an arcuate interior wall portion 80 from which a plurality of curved vanes 82 extend. The curved vanes 82 are arranged circumferentially around the bore 78 and are angled similar to the arcuate flow turning vanes 72 on the inlet structure 68. As fluid 18 exits the discharge housing 50 during an ejection cycle, the curved vanes 82 reinforce or amplify the swirling motion of the flowing fluid. This even further helps to impart a cleaning action to the interior surfaces of the main tubular section 52 of the discharge tube assembly 12 as the fluid flows through this portion of the discharge tube assembly 12.

With further reference to FIGS. 2 and 3, the arcuate flow turning vanes 72 essentially form a first plurality of vanes which, as noted above, impart a swirling motion to the fluid 18 as the fluid passes by and around the arcuate flow turning vanes 72. Importantly, the arcuate flow turning vanes 72 perform a plurality of additional operations. The arcuate flow turning vanes 72 also provide a quick path for the compressed air to leave the lower portion 36 of the fluid pump 14 before the entire flow channel within the discharge tube assembly 12 is open to air. This air can be used to identify when the pump 14 is empty and to turn off the supply air, thus limiting the amount of air in the output of the pump 14. The arcuate flow turning vanes 72 also help to separate the liquid 18 from the air as the two fluids attempt to leave the pump 14 during the ejection/discharge cycle. This is important for the flow detection system (not shown in FIG. 1) being used outside the wellbore 16, which is sensitive to two phase fluid flow. Without the arcuate flow turning vanes 72, air and liquid may form into pockets of air and water. These pockets sequentially collide into the sensing element of the flow detection system. The heavier liquid has more inertia and causes the sensing element to move to a position which is different than when just air is presented to the sensing element. This position may provide false data to the sensing element. The arcuate flow turning vanes 72 also allow the water to collect or stick to the surface of the vanes. The less dense pneumatic pumping air tunnels between the turning vanes. This helps eliminate or limit the two phase flow condition which might subject the sensor to false data. This small flow area is also easier for compressed air to travel through the arcuate flow turning vanes 72, as compared to water.

As it is discharged through the fluid pump 14, the turning volume of fluid 18 will spiral up the inside of the discharge housing 50 into the main tubular section 52 of the discharge tube assembly 12. This spinning will clean the interior wall 64*a* of the discharge housing 50 as well as the interior wall of the main tubular section 52. This spinning fluid 18 will also spin the discharge poppet 62 and help to clean it. The spinning discharge poppet 62 will also position itself in the center of the vortex of spinning fluid, which provides for even better sensor feedback. The rotating fluid column then spirals toward the curved vanes 82 of the DSI fitting 51, which essentially act as a second plurality of flow turning vanes. The curved vanes 82 reinforce or amplify the rotation (i.e., swirling motion) of the fluid 18 while expanding the fluid across the entire cross section of the main tubular section 52 of the discharge tube assembly 12. The strong swirling action imparted to the fluid 18 washes the inside walls of the main tubular section 52 through the entire length of the main tubular section 52.

It will also be appreciated that the angled surfaces 72*a* of the arcuate flow turning vanes 72 help to limit the amount of debris which will attempt to collect in (or on) the discharge housing 50 by increasing the rotating fluid flow velocity thru this rejoin. Adjacent ones of the arcuate flow turning vanes 72, as well as adjacent ones of the curved vanes 82, are also preferably spaced to allow at least three large particles to pass between adjacent pairs of arcuate flow turning vanes 72, as well as between adjacent pairs of curved vanes 82, without plugging. Such a spacing involves a separation of preferably at least about 0.375 inch, as denoted by arrows 84 in FIG. 4, although it will be appreciated that this separation may vary somewhat depending on the diameter of the inlet port 70 as well as the inlet screen 14*a* aperture diameter. A similar separation may be employed between the radially inward most portions of adjacent ones of the curved vanes 82. A height of each of the flow turning vanes, as indicated by arrows 85 in FIG. 4, may also vary considerably, but in one preferred form is about 0.250-0.500 inch. Likewise, a similar height may be employed with the curved vanes 82. However, it will be appreciated that the height and spacing of the flow turning vanes 72 and the curved vanes 82 need not be identical.

The rotating fluid column created by the discharge tube assembly 12 cleans the inside wall portions of the discharge tube assembly 12 on each pump ejection cycle. The benefit is a self-cleaning of the pump discharge tube assembly 12 internal surfaces, which reduces the frequency of cleaning and operation of the pump 14. Optionally, the pumping media (e.g., compressed air) may also contain small particles of sand or silt. These particles can act like a small sand blaster. The spiraling particles may even further help to slowly clean and polish all the interior surfaces of the discharge tube assembly 12 as they collide with the surface during an ejection cycle of the fluid pump 14. This self-cleaning is expected to significantly extend the time interval for service due to a plugged outlet. Plugged outlets are caused by a collection of particles which bridge across the inlet port 70 of the discharge housing 50. The self-cleaning also extends the time interval for servicing the discharge poppet 62 because of the cleaning process on each pump ejection cycle.

The discharge tube assembly 12 thus enables a cleaning action to be imparted to the components associated therewith during every ejection cycle of the fluid pump 14, and without the need for expensive additional components, and without requiring significant modifications to other components of the fluid pump. The discharge tube assembly 12 can be implemented with minimal additional cost, and without significantly increasing the overall complexity of the design of the fluid pump, and without significantly complicating its assembly and/or disassembly. It is a particular advantage of the discharge tube assembly 12 that it may even be retrofitted into existing pneumatic fluid pumps with little or no modifications to existing fluid pumps. However, it will also be appreciated that, depending on the specific pump decision, the discharge poppet 62 and a discrete area for housing the discharge poppet may not be needed. Also, the flow turning vanes 72 and/or curved vanes 82 may be employed/formed directly on one or both ends (i.e., inlet and/or outlet ends) of a fluid discharge tube, assuming the discharge poppet is not being used. Also, in the case of a pneumatic pump without a poppet, a ball check valve is required. In this case, turning vanes can be incorporated into the structure before and after the ball check valve. It will also be appreciated that the ball check chamber can have turning vanes incorporated into the flow chamber where the ball check resides.

Figure 6:
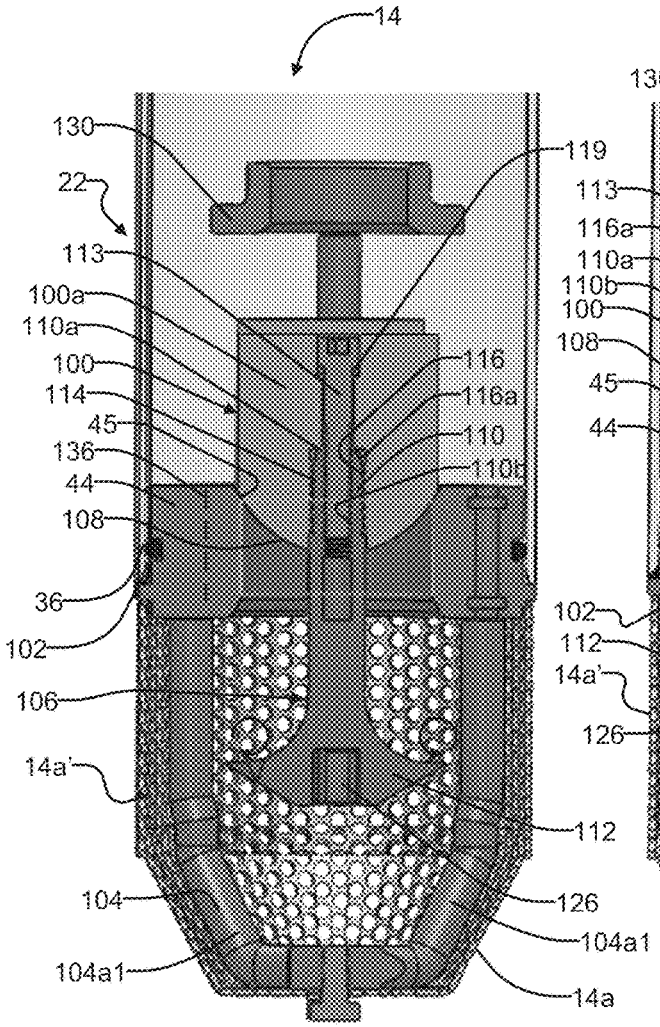
FIG. 6 is a side cross sectional view of a portion of the pump shown in FIG. 1 illustrating a different embodiment of the poppet inlet valve which incorporates a propeller structure for creating a pulse of fluid outwardly toward the inlet screen, which is effective for cleaning the inlet screen, when the poppet valve abruptly seats at the end of a fluid discharge cycle.
Figure 7:
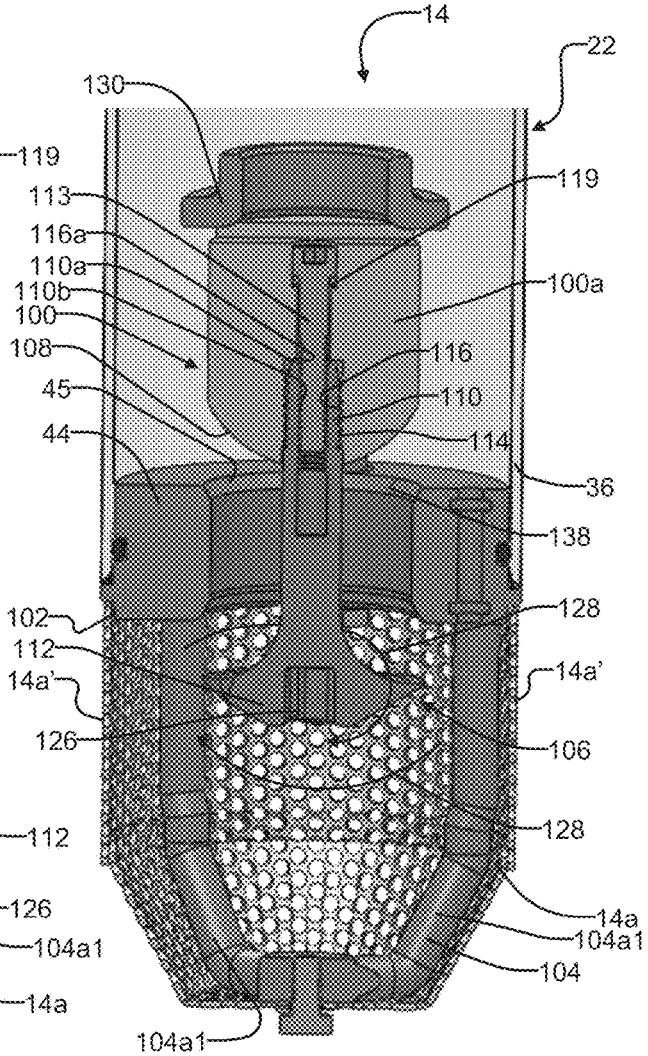
FIG. 7 shows the poppet valve of FIG. 6 while the poppet valve oscillating slightly as the poppet valve seats, while generating the fluid pulse.

Referring to FIGS. 6 and 7, a fluid inlet poppet valve 100 in accordance with another embodiment of the fluid poppet inlet valve 48 is shown. The pump in which the poppet valve 100 may be used may be the same as or similar to the pneumatically driven pump 14 shown in FIG. 1. However, the poppet valve 100 is readily adaptable for use in any pneumatically driven fluid pump which relies on a poppet style valve to seal a fluid inlet port. The poppet valve 100 may even be adapted for other pump applications; in fact the poppet valve 100 may potentially be used in connection with any pump port (inlet or ejection) which would normally be sealed closed by seating of a poppet valve, and where structure such as a screen or even the inside of a tube needs to be kept as clean and debris free as possible. When used in connection with the discharge various components of the system 10, the poppet valve 100 helps to ensure the entirety of the pump 14 is maintained as debris free as possible.

FIGS. 6 and 7 show the extreme lower end 36 of the pump 14 in enlarged fashion. The inlet screen 14*a* is secured to a lower edge portion 102 of the pump housing 22. A support frame 104, typically formed from at least three support elements 104*a*1 spaced apart from one another (e.g., in one example by 120 degrees from one another, although only two being visible in the cross sectional drawings of FIGS. 6 and 7) is positioned within the inlet screen 14*a* and helps to prevent damage to the inlet screen if the inlet screen is lowered into a wellbore and hits abruptly at the bottom of the wellbore. The inlet screen 14*a* also serves to keep larger particles of debris away from the inlet casting 44 that might otherwise interfere with proper seating of a portion of the inlet poppet valve body portion 100*a* on a seat 45 of the inlet casting.

Figure 8:
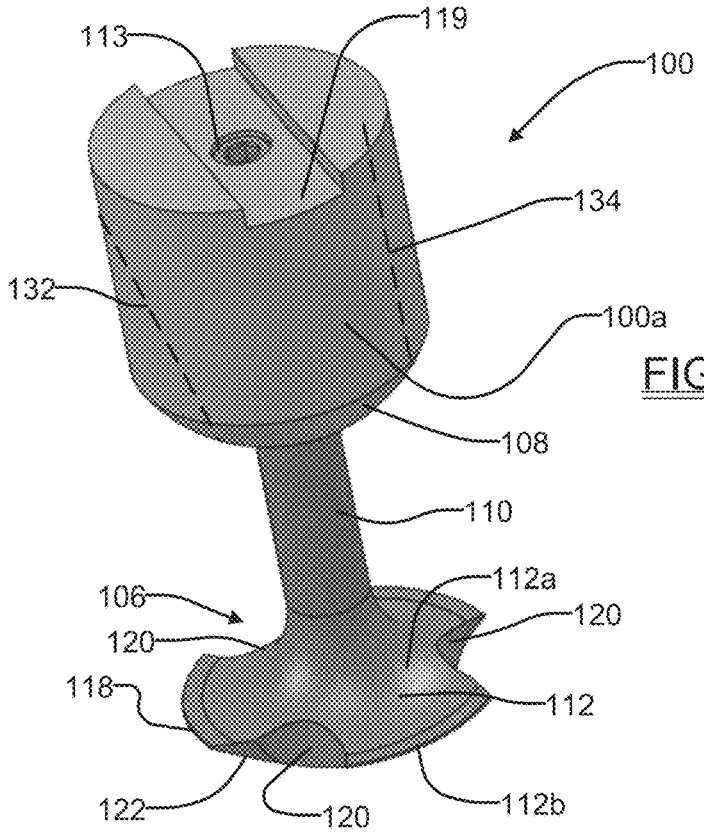
FIG. 8 shows a perspective top view of just the poppet valve and the propeller structure, which helps to further illustrate the features of the propeller structure.
Figure 9:
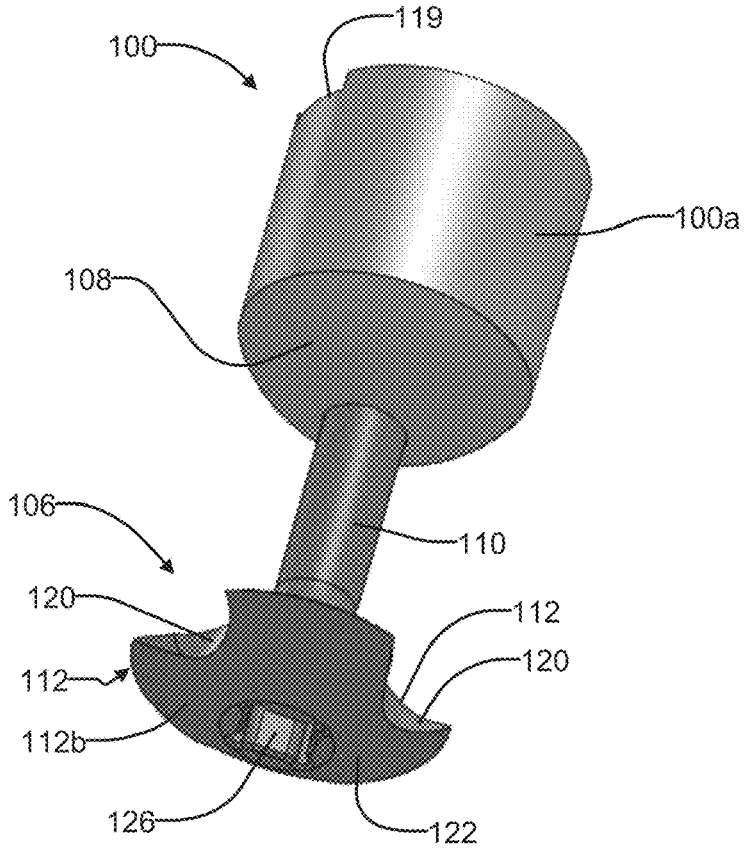
FIG. 9 shows a bottom perspective view of the poppet valve and the propeller structure.

A principal feature of the poppet valve 100 is a propeller structure 106 which is attached to a bottom sealing portion 108 of the poppet valve body portion 100*a*. The propeller structure 106 is shown in greater detail in FIGS. 8 and 9. In FIGS. 8 and 9 it can be seen that the propeller structure 106 includes a neck portion 110 which transitions into a propeller element 112 having a smoothly curving upper surface 112*a* and a smoothly curving lower surface 112*b*. In this example the propeller element 112 forms a generally circumferential propeller element, although it will be appreciated that the propeller element 112 need not be perfectly circular. The neck portion 110 in this example extends along a longitudinal centerline of the pump 14. With brief reference to FIG. 6, the neck portion 110 can be seen to include a threaded portion 114 which is threadably engaged at an axial center of the body portion 100*a*, and which projects axially outwardly from the bottom sealing portion 108 within a threaded bore 116 in the body portion 100*a* (the threaded bore 116 and the threaded portion 114 being visible only in FIGS. 6 and 7). The neck portion 110 transitions smoothly into the propeller element 112. The propeller element 112 includes a relatively thin or sharp edge 118 which transitions (i.e., enlarges) in thickness toward an axial center of the propeller element 112. The edge 118 may include one or more scalloped sections 120 spaced around the circumference of the sharp edge 118. A generally semi-conically shaped face 122 is formed on the propeller structure 112 which faces downwardly toward the inlet screen 14*a* when the poppet valve 100 is assembled into the pump 14.

From FIGS. 6 and 9 it can be seen that the propeller element 112 includes a square hole 126. The square shaped hole 126 accepts a 0.25" socket drive ratchet. The ratchet drive can fit inside the support elements 104*a*1 forming the support frame 104 and provide rotation to turn the neck portion 110 to threadably advance it into the threaded bore 116 in the body portion 100*a*. An end of the neck portion 110 has a spherical surface 110*a*. This spherical surface 110*a* creates a water seal when compressed into a bottom face 116*a* of the threaded bore 116, and forms a primary water seal along the neck portion 110. A standard threaded fastener 113 is then threaded into a threaded bore 110*b* in the neck portion 110. The thread pitch on the threaded fastener 113 is preferably different than the thread pitch in the threaded bore 116, which prevents the propeller structure 106 from turning off of the bottom sealing portion 108. The standard threaded fastener 113 may be captured by an interference fit on the threaded fastener 113 head and the body portion 100*a*. A secondary seal is created by an O-ring 119. The O-ring 119 is compressed by the threaded fastener 113 head portion. This compression also helps to prevent loosening rotation of the threaded fastener 113 from the threaded bore 110*b* in the neck portion 110.

While FIGS. 8 and 9 illustrate the propeller element 112 incorporating three such scalloped sections 120, it will be appreciated that a greater or lesser number of such scalloped sections may be included to suit the particular needs of a given application. The function of the scalloped sections 120 will be described in the following paragraphs. The propeller element 112 and the neck portion 110 may be made from high strength plastic or a suitable metal, which in one example may be 316 stainless steel. Preferably the diameter of the propeller element 112 is just slightly small than the internal diameter defined by the inlet screen support frame 104, for example by a spacing of about 0.312 inch from each support element 104*a*1 of the support frame 104. FIGS. 8 and 9 also show that the body portion 100*a* may include a relatively shallow slot 119 which allows fluid (e.g., water) to flow around the body portion 100*a* which can help to keep the upper end of the body portion 100*a* from getting stuck on a hard stop 130 (visible in FIGS. 6 and 7) at the top of a fill cycle or stroke.

During a fluid inlet cycle when the poppet valve 100 is raised off the seat 45, the propeller element 112 does not appreciably obstruct the free flow of fluid through the inlet screen 14*a* and past the poppet valve 100. Thus, fluid is free to enter the pump 14 through the inlet screen 14*a* during a fluid fill cycle. However, when pressurized air is admitted to the pump 14 during a fluid eject cycle, the pressurized air and the weight of the fluid column acts on the poppet valve 100 to force it down onto the seat 45 of the inlet casting 44 to close off the flow of fluid into the interior area of the pump housing 22. This hydraulic force drives the poppet valve 100 toward the valve seat 45 of the inlet casting 44 with a relatively high velocity, at which point it comes to a hard stop on the seat 45. This rapid downward motion of the poppet valve 100 produces a reverse "pulse" of fluid flow which pushes the water off the face 122 of the propeller element 112 towards the inlet screen 14*a*. This reverse pulse of fluid flow is effective in dislodging particles which are stuck or attached to either the inside surface or the outside surface of the inlet screen 14*a*. These particles then have the opportunity to sink away from the pump inlet screen 14*a* to the bottom of the wellbore 16.

To further encourage the dislodgement of particles out of and away from the inlet screen 14*a*, a small turn in the reverse fluid pulse is introduced by the scalloped sections 120 on the edge 118 of the propeller structure 112. The three scalloped sections 120 turn the reverse fluid pulse as the reverse fluid pulse passes through them. The turning fluid flow is illustrated by lines 128 in FIG. 7, and forms somewhat of a sharp, swirling fluid pulse. The turning fluid flow is then directed radially outwardly toward a sidewall portion 14*a*' of the inlet screen 14*a*. This area would otherwise not be supplied any fluid from the propeller element face 122.

The third way the propeller structure 112 helps to clean the interior area of the pump 14 is through the abrupt stop when the poppet valve 100 seats on the seat 45. This abrupt stop produces a small shock wave in the fluid. This abrupt stoppage also produces a momentary mechanical vibration. This momentary mechanical vibration momentarily shakes the entire pump 14. This momentary, abrupt shaking action, taken in connection with the reverse fluid pulse and swirling fluid flow generated by the propeller element 112, encourages any loosely held particles that may be attached to the inlet casting 44, or portions of the poppet valve 100 or the inlet screen 14*a*, to be ejected from the surface they are attached to. With the particles detached from the surfaces, they sink away from the pump 14 if they are on the outside of the pump 14. If these particles are on the inside of the pump 14, they can be expelled with the fluid in the pump during the next pump ejection cycle.

If the pump 14 is a float controlled pump, then the pump inlet screen 14*a* will self-clean every eject cycle of the pump. The cleaning cycle is different if there is a programmable electronic controller used with the pump 14. The controller's program will typically have a specified number of cycles (or time) between cleaning cycles. The cleaning cycle is different than the normal pump cycle. A normal pump cycle will empty the pump 14 completely. A cleaning cycle will often be a series of short eject (i.e., ON) and fill cycles in close repetition. The pump 14 will be slowly emptied with the series of short pump cycles. The short cycles allow the inlet poppet valve 100 to fully open and then rapidly close. The other benefit of the short pump cycles is that the pump 14 becomes buoyant in the last couple of cycles. This buoyant state allows the mass of the poppet valve 100 to shake the pump 14 more strongly due to less mass of water inside the pump. The buoyant state also allows the pump 14 to physically move around inside the wellbore 16. This repositioning allows the particles another opportunity to sink away from the inlet screen 14*a*.

One preferred self-Cleaning pumping sequence may be defined as follows:

- pump 14 refill until pump is full;
- pump turned on (fluid eject cycle started) for one second and then pump turned back off;
- pump fill cycle started and maintained for a three second duration;
- pump 14 turned on (eject cycle started) for one second, and then eject cycle stopped;
- pump 14 fill cycle started and maintained for three seconds;
- pump 14 turned on (i.e., eject cycle started) for one second;
- pump 14 fill cycle started and maintained for three seconds;
- pump 14 turned back on (i.e., eject cycle started) and maintained on for two seconds, then the pump is turned off;
- pump fill cycle is started and maintained for three seconds and then terminated;
- pump 14 is turned back on (eject cycle started) for two seconds, and then turned off;
- pump fill cycle is started and maintained for three seconds;
- pump 14 cleaning sequence is terminated and the electronic controller switches back to controlling the pump in the normal pump operating mode.

It will be appreciated that the pump "On" times and refill times are programmable. The number of cycles can also be programmed. The entire cleaning sequence can then be adjusted to best clean the pump. The specific variable selections will be influenced by the pump depth, submergence and head pressure and the composition of the fluid being pumped. These features enable tuning of the cleaning sequence to account for the type(s) of contaminates in the well which are adhered to the various pump 14 surfaces, and which would normally result in undesirably shortening the durations between normally scheduled maintenance of the pump.

The inlet poppet valve 100 can potentially be retrofitted into existing pumps, although the dimensions of the propeller structure 106 may need to be adjusted depending on internal dimensions of the inlet screen being used with the pump. The propeller structure 106 does not add appreciable cost, weight or complexity to the pump 14. The propeller structure 106 also does not require any significant modifications to the inlet poppet valve of a pump or the valve body structure on which the poppet valve seats. Still further, the inlet poppet valve 100 described herein does not require any modifications to how an electronic controller would normally need to be operated to control the pump during its normal pumping operation, aside from possibly introducing the cleaning sequence described herein, which again would only be performed periodically.

With further reference to FIG. 8, optionally the body portion 100*a* could include one or more angled pathways 132 and/or one or more longitudinal pathways 132. The angled pathway(s) 132 may help to induce a turn on the water column flowing toward the propeller element 112. The straight or longitudinal pathway(s) 134 provide a flow of water which attaches to the surface of the propeller element 112 and directs water to help clean the propeller element and the inlet screen 14*a*. With brief reference to FIGS. 6 and 7, one or more bores 136 in the inlet casting 44 (visible only in FIG. 6), or possibly one or more slots or grooves 138 (visible only in FIG. 7) at a surface area of the inlet casting 44 where the body portion 100*a* makes contact with the inlet casting, may also be included to introduce a swirling motion to water passing through the inlet casting or to direct water onto the bottom sealing portion 108 of the body portion 100*a* and the propeller element 112 and onto the inlet screen 14*a*. These features can augment the benefits of the propeller element 112 in helping to keep the inlet screen 14*a* and other components of the pump 14 clean.

Referring to FIGS. 10-15, a fluid turning system 200 is shown in accordance with one embodiment of the present disclosure integrated for use with the pump 10. It will be appreciated immediately that while the fluid turning system 200 is well suited for use with pneumatically driven pumps, it is not limited to use with only pneumatically driven pumps. The fluid turning system 200 may be used with electrically powered pumps, or virtually any other type of pump that pumps a fluid which may carry contaminants capable of plugging a fluid flow line or flow control component (e.g., valve).

In FIG. 10 the fluid turning system 200 (hereinafter simply "FT" system 200) may be secured to a section of discharge tubing 202, which is in turn coupled to the head assembly 28 of the pump 10. Alternatively, as will be appreciated from the following paragraphs, the FT system 200 could be directly attached to a fitting or boss associated with the head assembly 28. The FT system 200 is coupled to a length of discharge tubing 204 which routes pumped fluid 18 (FIG. 1) from the well 18 to fluid reservoir.

Figure 11:
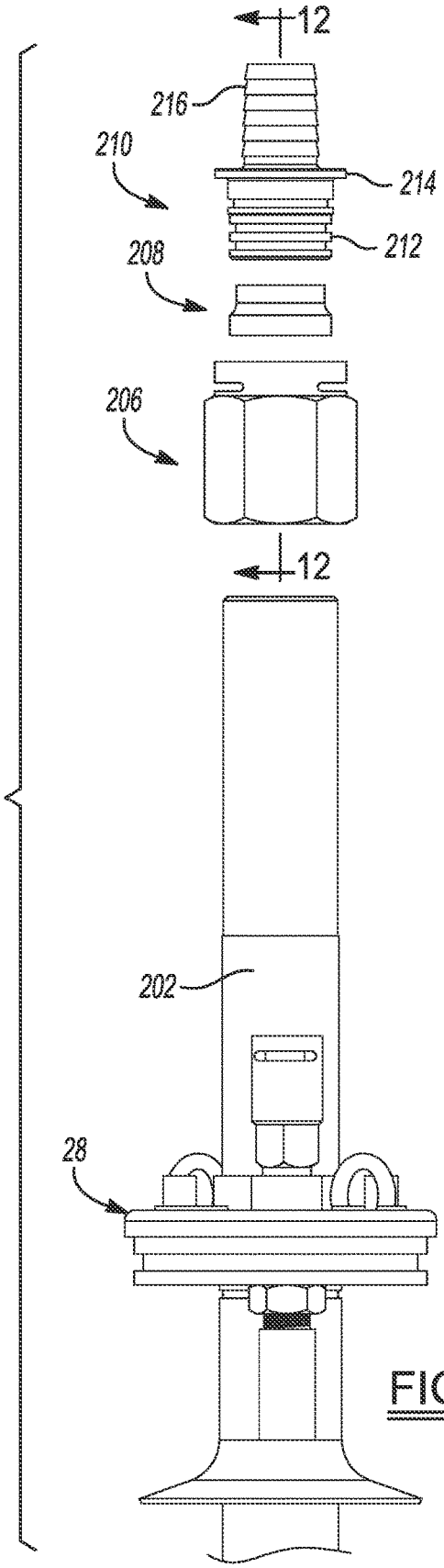
FIG. 11 is an exploded elevational side view of the fluid turning system of FIG. 10 showing the components that make up the system.

FIG. 11 illustrates one embodiment of the components of the FT system 200. The FT system 200 may include a lower outer housing component 206, a ring-shaped flow turning element 208 and an upper outer housing component 210. The upper outer housing component 210 has a threaded portion 212, a flange 214 and a barbed portion 216 extending from the flange. The barbed portion 216 may be inserted into a terminal end of the discharge tubing 204 with a friction fit to form a fluid tight coupling therebetween. The flow turning element 208 rests partially within the lower outer housing 206 when the FT system 200 is fully assembly.

Referring to FIGS. 12 and 15, the lower outer housing portion 206 can be seen to include a partial circumferential channel 218, an interior cavity 220 and a bottom wall 222 in the interior cavity 220. The flow turning element 208 rests against the bottom wall 222 within the interior cavity 220 when the FT system 200 is fully assembled. The upper outer housing component 210 may include a circumferential groove 224 which aligns with the partial circumferential channel 218 when the two components are assembled. A snap ring 217 may then be inserted into the aligned channel/groove 218/224 to hold the two components together. Once assembled together, a lower wall portion 210*a* of the upper outer housing component 210 holds the flow turning element 208 within interior cavity 220.

Figure 13:
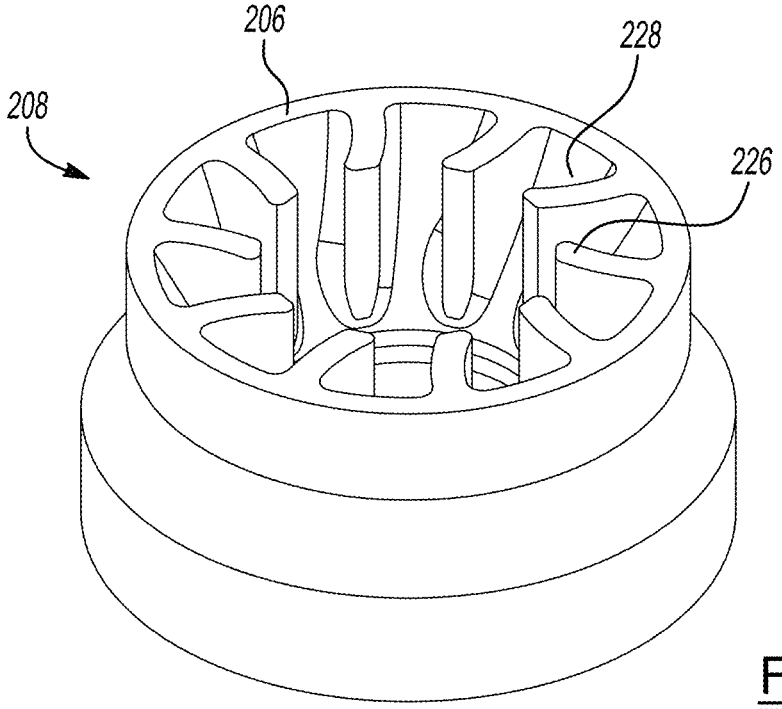
FIG. 13 is an enlarged perspective view of just the flow turning element shown in FIG. 12.

With further reference to FIGS. 13-15, the flow turning element 208 can be seen to include a reduced diameter inlet portion 208*a* and plurality of curving, circumferentially spaced vanes 226 projecting from an inner wall 228 of the flow turning element 208. The curving, circumferentially spaced vanes 226 project inwardly beyond an inner wall portion 230 (FIG. 15) of the upper outer housing component 210 so that they are projecting into the fluid flow stream being discharged through the FT system 200. The fluid low stream is indicated by arrow 232 in FIG. 15. The vanes 226 serve to impart a circumferential, swirling flow to the fluid being discharged through the FT system 200, as indicated by arrow 234 in FIG. 13. The swirling fluid flow exerts a strong, turbulent cleaning action on the interior wall of the discharge tubing 204 (FIG. 10) as the fluid enters and flows through the tubing. The swirling flow also acts on downstream flow control components (e.g., valves) helping to maintain such components contaminant free and to dislodge contaminants that may be sticking to the inside surface of the discharge tubing 204 and various downstream components.

It will be understood that the reduced diameter inlet 208*a* serves the purpose of first providing a "shadow" to allow the vanes 226 to be placed on the circumference of the discharge tube (e.g., such as discharge tube 42 in FIG. 1). This "shadow" protects the vanes from debris flowing in the discharge tube. No sharp edges are presented so that the particles cannot directly impact them. Another benefit is that the curved surface formed by the reduced diameter inlet 208*a* is that the curved surface helps initially direct the fluid flow stream to the portions of the wall 228 nearest the inlet end of the flow turning element 208. The wall 228 surface changes shape as the vanes 226 begin to project therefrom and become exposed to the flow stream. The curved profile of the vanes 226 as they "grow" (i.e., increase in the distance they project from the wall 228) help to enable them to be self-cleaned and also to impart the turning of the fluid flow column.

The FT system 200 thus forms a system which can be retrofit into virtually any existing pump system (e.g., piston drive, float driven), or to any other type of fluid flow channeling device, and is therefore not limited to use with only fluid pumps. Alternatively, the FT system 200 may be incorporated in a newly manufactured pump, either as a standalone element, or possible integrally formed within an existing fitting or element that would otherwise be used to help channel fluid out from, or even into, the pump or device. In the example shown in FIGS. 10-15, the FT system 200 is coupled to a fluid output port of the pump 10, although the FT system 200 could just as readily be coupled at any point downstream of the pump's 10 fluid output port, or upstream of the pump's input, or even within a portion of the fluid discharge conduit located within the interior of the pump housing. Still further, the FT system 200 could be located on the inlet side of a fluid flow device or system, to impart a flow to the fluid before the fluid enters the device or system. Accordingly, the FT system 200 is not limited to use at only one specific location with respect to the pump 10, or with respect to a different type of device besides a pump.

The FT system 200 can be quickly and easily disassembled using only standard hand tools, in the field, if necessary. Alternatively, the FT system 200 may potentially be integrally formed with the fluid outlet of the pump head assembly 28. In any of the above described implementations, the FT system 200 forms a highly cost effective means for helping to maintain the discharge tubing 204 and various downstream components clean and free of contaminants and debris that could otherwise cause clogging and or reductions in the flow volume through the discharge tubing 204. The FT system 204 is also highly economical and does not necessitate any modifications to the construction of the pump 10 itself, nor does it significantly increase the weight of the pump, nor require any changes in the operation (e.g., cycling) of the pump, nor necessitate the use of a larger diameter wellbore that what would otherwise be needed for a given pump. Maintenance and periodic cleaning of the FT system 200 can be performed quickly and easily, without taking the pump off line and with little down time of the pump 10.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A fluid turning system adapted for communication with a pump, the fluid turning system comprising:

a housing having mating first and second housing components, the housing configured to receive flowing fluid; and an independent, ring-like flow turning element removably housed within one of the first and second housing components, and retained therein by the other one of the first and second housing components when the first and second housing components are assembled and secured together, the ring-like flow turning element having a plurality of curved, circumferentially spaced vanes extending radially and projecting into a flow path of the flowing fluid, the curved, circumferentially spaced vanes configured to impart a swirling, circumferential flow to the flowing fluid to help prevent contaminants in the flowing fluid from adhering to downstream system components.

2. The fluid turning system of claim 1, wherein:

the first housing component comprises a lower outer housing component; and the second housing component comprises an upper outer housing component.

3. The fluid turning system of claim 2, wherein:

the lower outer housing component includes an interior cavity configured to receive the ring-like flow turning element.

4. The fluid turning system of claim 3, wherein the interior cavity is formed in the lower outer housing component, and wherein the ring-like flow turning element is positioned within the interior cavity and captured in the interior cavity by a lower wall portion of the upper outer housing component.

5. The fluid turning system of claim 1, wherein the ring-like flow turning element includes a reduced diameter inlet portion.

6. The fluid turning system of claim 1, wherein the curved, circumferentially spaced vanes project from an inner wall portion of the ring-like flow turning element.

7. The fluid turning system of claim 2, wherein:

the lower outer housing component includes a first circumferential groove; and the upper outer housing component includes a second circumferential groove that aligns with the first circumferential groove when the upper outer housing component is assembled to the lower outer housing component, wherein the first circumferential groove and the second circumferential groove enable an external fastener to be secured therein to hold the upper and lower outer housing components together when aligned.

8. The fluid turning system of claim 2, wherein the upper outer housing component comprises a barbed portion configured to engage an interior surface of a discharge conduit.

9. The fluid turning system of claim 2, wherein the upper outer housing component includes a flange which seats against the lower outer housing component when the upper and lower outer housing components are coupled together.

10. The fluid turning system of claim 5, wherein the reduced diameter inlet portion comprises at least one curved surface.

11. A landfill pump system disposed in a wellbore and configured to remove a fluid from within the wellbore, the landfill pump system comprising:

an upper housing component;

a lower housing component securable to the upper housing component; and an independent ring-like flow turning element removably disposed within one of the upper and lower housing components, and retained therein by the other one of the upper and lower housing components when the upper and lower housing components are assembled and secured together, the ring-like flow turning element having a plurality of curved, circumferentially spaced vanes extending radially and projecting into a flow path of the fluid, each vane of the plurality of curved, circumferentially spaced vanes extending over a full length of the ring-like flow turning element, and configured to impart a swirling, circumferential flow to the fluid to help prevent contaminants in the fluid from adhering to downstream system components.

12. The landfill pump system of claim 11, wherein the lower housing component includes an internal cavity, and wherein the ring-like flow turning element is disposed within the internal cavity.

13. The landfill pump system of claim 11, wherein the ring-like flow turning element includes a reduced diameter inlet portion configured to accelerate a flow of the fluid through the ring-like flow turning element.

14. The landfill pump system of claim 12, wherein the upper housing component comprises a barbed portion configured to engage an interior surface of a fluid discharge conduit.

15. The landfill pump system of claim 12, wherein:

the lower housing component includes a first circumferential channel; and the upper housing component includes a second circumferential channel that aligns with the first circumferential channel when the upper housing component is assembled to the lower housing component, wherein the first circumferential channel and the second circumferential channel enable an external fastener to be secured therein to hold the upper and lower housing components together when aligned.

16. A flow turning system for use with a discharge conduit operably associated with a discharge port of a fluid pump, the flow turning system comprising:

an upper outer housing component;

a lower outer housing component securable to the upper outer housing component; and an independent, ring-like flow turning element removably disposed within one of the upper and lower outer housing components, and retained therein by the other one of the upper and lower outer housing components when the upper and lower outer housing components are assembled and secured together, the ring-like flow turning element having a plurality of curved, circumferentially spaced vanes extending radially and projecting into a flow path of a fluid, each vane of the plurality of curved, circumferentially spaced vanes extending over a major length portion of the ring-like flow turning element to form an unobstructed opening at a flow discharge side of the ring-like flow turning element, and configured to impart a swirling, circumferential flow to the fluid to help prevent contaminants in the fluid from adhering to downstream system components.

17. The flow turning system of claim 16, wherein the upper outer housing component includes a barbed portion configured to engage an interior surface of the discharge conduit.

18. The flow turning system of claim 16, wherein the lower outer housing component comprises an internal cavity, and wherein the ring-like flow turning element is seated within the internal cavity and held therein by the upper outer housing component.

19. The flow turning system of claim 16, wherein the fluid pump is coupled to at least one of the upper outer housing component and the lower outer housing component.

* * * * *